US005165847A

United States Patent [19]

Proctor et al.

[11] Patent Number: 5,165,847

[45] Date of Patent: Nov. 24, 1992

[54] TAPERED ENLARGEMENT METERING INLET CHANNEL FOR A SHROUD COOLING ASSEMBLY OF GAS TURBINE ENGINES

[75] Inventors: Robert Proctor; John R. Hess, both of West Chester, Ohio

[73] Assignee: General Electric Company, Cincinnati, Ohio

[21] Appl. No.: 702,548

[22] Filed: May 20, 1991

[51] Int. Cl.[5] ..... F01D 5/18

[52] U.S. Cl. ..... 415/115; 415/116

[58] Field of Search ..... 415/115, 116, 173.1, 415/173.3, 174.2

[56] References Cited

U.S. PATENT DOCUMENTS

| | | | |
|---|---|---|---|
| 3,583,824 | 6/1971 | Smuland | 415/173.1 |
| 3,628,880 | 12/1971 | Smuland | 415/115 |
| 3,800,864 | 4/1974 | Hauser et al. | 165/47 |
| 3,844,343 | 10/1974 | Burggarf | 415/115 |
| 3,975,901 | 8/1976 | Hallinger et al. | 415/115 |
| 4,017,213 | 4/1977 | Przirembel | 416/97 |
| 4,222,707 | 9/1980 | Drouet et al. | 415/116 |
| 4,303,371 | 12/1981 | Eckert | 415/116 |
| 4,317,646 | 3/1982 | Steel et al. | 415/116 |
| 4,526,226 | 7/1985 | Hsia et al. | 165/109 |
| 4,551,064 | 11/1985 | Pask | 415/173.1 |
| 4,573,865 | 3/1986 | Hsia et al. | 415/115 |
| 4,693,667 | 9/1987 | Lenz et al. | 415/115 |
| 4,820,116 | 4/1989 | Hovan et al. | 415/115 |
| 5,039,562 | 8/1991 | Liang | 415/115 |
| 5,048,288 | 9/1991 | Bessette et al. | 415/116 |

*Primary Examiner*—John T. Kwon

*Attorney, Agent, or Firm*—John R. Rafter; Jerome C. Squillaro

[57] ABSTRACT

To cool the shroud in the high pressure turbine section of a gas turbine engine, high pressure cooling air is directed in metered flow through channels, which include tapered enlargement frustroconical recuperators, to baffle plenums and thence through baffle perforations to impingement cool the shroud rails and back surface. The baffle perforations and the convection cooling passages are interactively located to achieve maximum cooling benefit and highly efficient cooling air utilization.

9 Claims, 2 Drawing Sheets

TAPERED ENLARGEMENT METERING INLET CHANNEL FOR A SHROUD COOLING ASSEMBLY OF GAS TURBINE ENGINES

The present invention relates to gas turbine engines and particularly to a tapered enlargement of an inlet port for the cooling assembly of a gas turbine engine including the shroud surrounding the rotor in the high pressure turbine section of a gas turbine engine.

This application is related to co-pending U.S. patent application Ser. No. 07/702,549 and assigned to the assignee hereof, and filed concurrently herewith, and the disclosure of which is expressly incorporated by reference herein.

BACKGROUND OF THE INVENTION

A known approach for increasing the efficiency of a gas turbine engine suggests raising the turbine operating temperature. As operating temperatures are increased, the thermal limits of certain engine components may be exceeded, resulting in material failure or, at the very least, reduced service life. In addition, the increased thermal expansion and contraction of these components adversely effects clearances and their interfitting relationships with other components of different thermal coefficients of expansion. Consequently, these components must be cooled to avoid potentially damaging consequences at elevated operating temperatures. It is common practice then to extract from the main air stream a portion of the compressed air at the output of the compressor for cooling purposes. So as not to unduly compromise the gain in engine operating efficiency achieved through higher operating temperatures, the amount of extracted cooling air should be held to a small percentage of the total main air stream. This requires that the cooling air be utilized with utmost efficiency in maintaining the temperatures of these components within safe limits.

A particularly critical component subjected to extremely high temperatures is the shroud located immediately beyond the high pressure turbine nozzle from the combustor. The shroud closely surrounds the rotor of the high pressure turbine and thus defines the outer boundary of the extremely high temperature energized gas stream flowing through the high pressure turbine. To prevent material failure and to maintain proper clearance with the rotor blades of the high pressure turbine, adequate shroud cooling is a critical concern.

One approach to shroud cooling, such as disclosed in commonly assigned U.S. Pat. Nos. 4,303,371 to Eckert and 4,573,865 to Hsia et al., provides various arrangements of baffles having perforations through which cooling air streams are directed against the back or radially outer surface of the shroud to achieve impingement cooling thereof. Impingement cooling, to be effective, requires a relatively large amount of cooling air, and thus engine efficiency is reduced proportionately. Cooling air is generally supplied to a plenum adjacent the shroud. Air is supplied through inlet ports with little regard for the aerodynamic effects of the flow within the plenum and its subsequent effect on engine cooling.

It is accordingly an objective of the present invention to provide an improved cooling assembly for maintaining the shroud in the high pressure turbine section of a gas turbine engine within safe temperature limits.

A further objective is to provide a shroud cooling assembly of the above-character, wherein effective shroud cooling is achieved using a lesser amount of pressurized cooling air.

An additional objective is to provide a shroud cooling assembly of the above-character, wherein the same cooling air is applied in a succession of cooling modes to maximize shroud cooling efficiency.

Another objective is to provide a shroud cooling assembly of the above-character, wherein heat conduction from the shroud into the supporting structure therefor is reduced.

A still further objective is to provide an inlet port specially configured to reduce the aerodynamic effects within a cooling plenum and thereby increase shroud cooling efficiency.

Other objectives and features will be apparent from the further description which appear hereinafter.

SUMMARY OF THE INVENTION

In accordance with the present invention, there is provided an assembly for cooling a shroud in a high pressure turbine section of a gas turbine engine which utilizes the same cooling air in a succession of three cooling modes, including impingement cooling, convection cooling, and film cooling. In the impingement cooling mode, pressurized cooling air is introduced to baffle plenum through metering holes in a hanger supporting the shroud as an annular array of interfitting arcuate shroud sections closely surrounding a high pressure turbine rotor. Baffle plenums associated with the shroud sections are defined by a pan-shaped impingement baffle affixed to the hanger, also in the form of an annular array of interfitted arcuate hanger sections. Each baffle is provided with a plurality of perforations through which air flows and is directed into impingement cooling contact with the back or radially outer surface of the associated shroud section.

To achieve convection mode cooling in accordance with the present invention, the shroud sections are provided with a plurality of straight through-passages extending through the shroud. The baffle perforations are judiciously positioned such that the impingement cooling air streams contact the shroud back surface at locations that are between the passage inlets, to optimize impingement cooling consistent with efficient utilization of cooling air. The impingement cooling air then flows through the passages to provide convection cooling of the shroud. These passages are concentrated in the forward portions of the shroud sections, which are subjected to the highest temperatures, and are relatively located to interactively increase their convective heat transfer characteristics.

The convection cooling air exiting the passages then flows along the radially inner surfaces of the shroud sections to afford film cooling.

A specially configured metering channel is provided to regulate air mass flow, pressure and air flow turbulence within the baffle plenum. This permits the efficient use of the available cooling airflow to cool the engine with the above mentioned impingement cooling, convention and film cooling processes.

The invention accordingly comprises the features of construction, combination of elements and arrangement of parts, all as set forth below, and the scope of the invention will be indicated in the claims. For a full understanding of the nature and objects of the present invention, reference may be had to the following detailed description taken in conjunction with the accompanying drawings, in which:

DETAILED DESCRIPTION OF THE INVENTION

Figure 1:
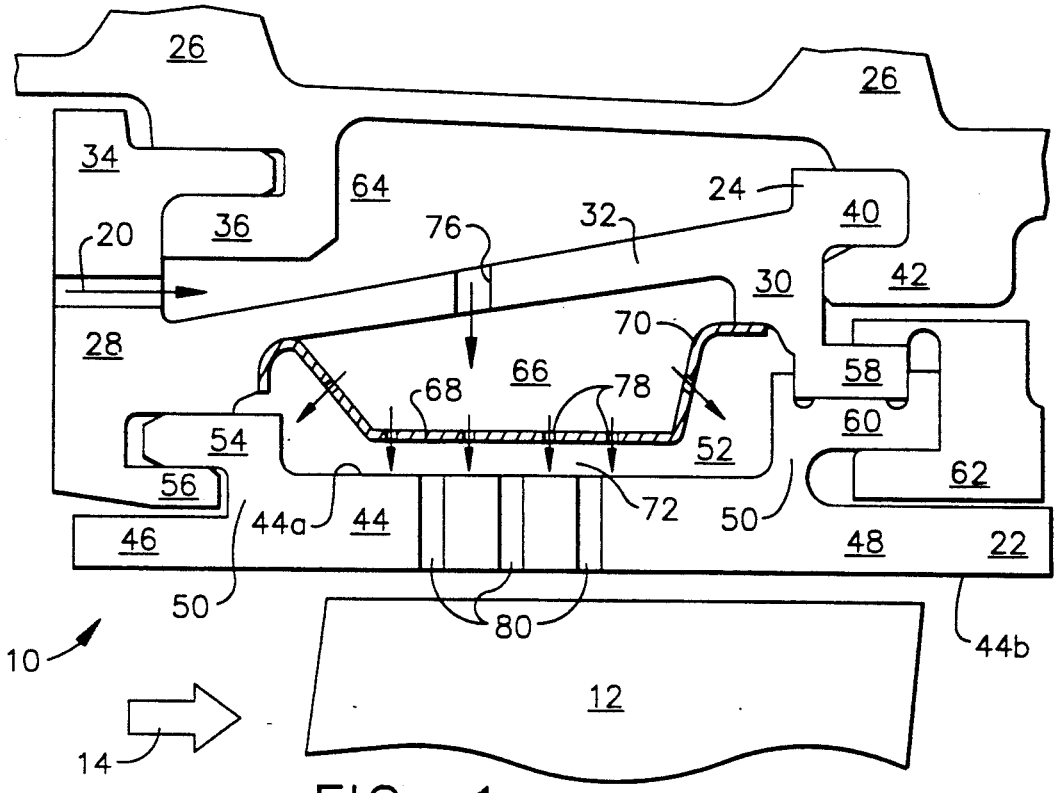
FIG. 1 (PRIOR ART)
FIG. 1 is an illustration of an axial sectional view of a conventional shroud cooling assembly.

Referring now to the drawings in which corresponding reference numerals refer to like parts throughout the several views of the drawings; a conventional shroud assembly is generally indicated at 10 in FIG. 1, and is disposed in closely surrounding relation with turbine blades 12 carried by the rotor (not shown) in a high pressure turbine section of a gas turbine engine such as that which is shown and described in U.S. Pat. Nos. 3,842,597 and 3,861,139 assigned to the assignee of the present and the disclosures of which are incorporated by reference herein. As is explained in co-pending U.S. patent application Ser. No. 07/702,549, a turbine nozzle generally can include a plurality of vanes affixed to an outer band for directing the main core engine gas stream, indicated by arrow 14, from the combustor (not shown) through the high pressure turbine section to drive the rotor in traditional fashion.

As shown in FIG. 1 hereof, shroud cooling assembly 10 includes a shroud in the form of an annular array of arcuate shroud sections, one of which is generally indicated at 22, and which are held in position by an annular array of arcuate hanger sections, one of which is generally indicated at 24, and, in turn, are supported by the engine outer case, which is generally indicated at 26. More specifically, each hanger section includes a fore or upstream rail 28 and an aft or downstream rail 30 integrally interconnected by a body panel 32. The fore rail is provided with an outer rearwardly extending flange 34 which radially overlaps a forwardly extending flange 36 carried by the outer case 26. Means can be provided to angularly locate the position of each hanger section 24. Similarly, the aft rail 30 is provided with a rearwardly extending flange 40 in radially overlapping relation with a forwardly extending outer case flange 42 to the support of the hanger sections from the engine outer case 26.

Each shroud section 22 is provided with a base 44 having radially outwardly extending fore and aft rails 46 and 48, respectively. These rails are joined by radially outwardly extending and angularly spaced side rails 50, to provide a shroud section cavity 52. Shroud section fore rail 46 is provided with a forwardly extending flange 54 which overlaps a flange 56 rearwardly extending from hanger section fore rail 28 at a location radially inward from flange 34. A hanger flange 58 extends rearwardly from hanger section aft rail 30 at a location radially inward from flange 40 and is held in lapping relation with an underlaying flange 60 rearwardly extending from shroud section aft rail 48 by an annular retaining ring 62 of C-shaped cross section.

The hanger 24 in combination with case 26 defines an upper plenum 64 therebetween and which receives cooling flow 20 therein. The hanger 24 in combination with the baffle base 68 defines a baffle plenum 66 therebetween which receives air through a metering hole 76 in hanger 24.

Pan-shaped baffles 68 are affixed at their rims 70 to the hanger sections 24 by suitable means, such as brazing, at angularly spaced positions such that a baffle is centrally disposed in each shroud section cavity 52. Each baffle 68 divides and thus defines with the hanger section to which it is affixed a shroud plenum 72 adjacent to the shroud section base 44. In practice, each hanger section 24 may mount three shroud sections and a baffle section consisting of three circumferentially spaced baffle pans 68, one associated with each shroud section. Each baffle plenum 66 then serves a complement of three pans and three shroud sections.

A high pressure cooling air flow 20 extracted from the output of a compressor (not shown) immediately ahead of the combustor is routed to the upper plenum 64 and forced into each baffle plenum 66 through metering holes 76 provided in the hanger section body panel 32. From the baffle plenum 66 high pressure air is forced through perforations 78 in the baffles 68 and cooling air streams impinge on the back or radially outer surfaces **44*a* of the shroud section bases 44. The impingement cooling air then flows through a plurality of passages 80 through the shroud sections base 44 to provide convection cooling of the shroud. Upon exiting these convection cooling passages, cooling air flows rearwardly with the main gas stream 14 along the front or radially inner surfaces 44*b* of the shroud sections to further provide film cooling of the shroud 22**.

Figure 2A:
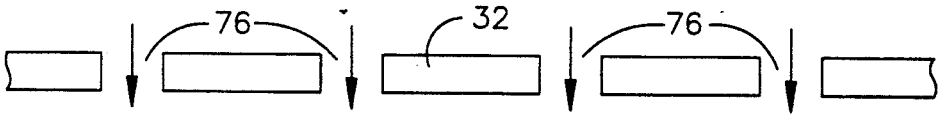
FIGS. 2A and 2B illustrate the plenum pressure distribution and airflow achieved by the inlet of FIG. 1.
Figure 2B:
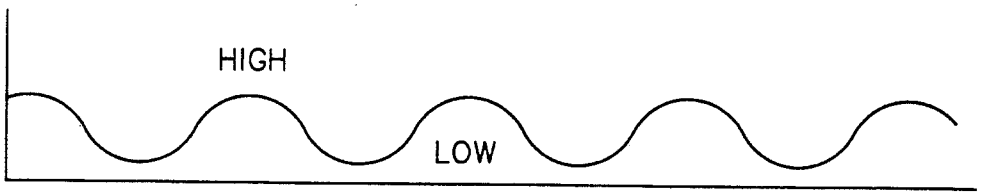

In a conventional design such as that shown in FIG. 1, the shroud base experiences non-uniform impingement cooling attributable a pressure differential established within the baffle plenum 66 by the cooling air supply flow 20. The pressure gradient schematically illustrated in FIG. 2B is established by the metering holes due to the high pressure ratio across them. The non-uniform pressure differential and flow distribution across the plenum 66 results in a concomitant differential in airflow through the shroud cooling ports 80. This pressure differential exists despite the presence of baffle 68. Although some attenuation will have occurred, variation in cooling flow can rob an engine of performance efficiency because a greater than necessary cooling flow 20 may be required due to pressure variations within the plenum 66 to adequately cool the shroud. Flow variations can also result in over cooling one or more portions of the shroud 22 while under cooling another. Accordingly, there exists a need to provide a cooling assembly which provides more uniform shroud cooling.

Figure 3:
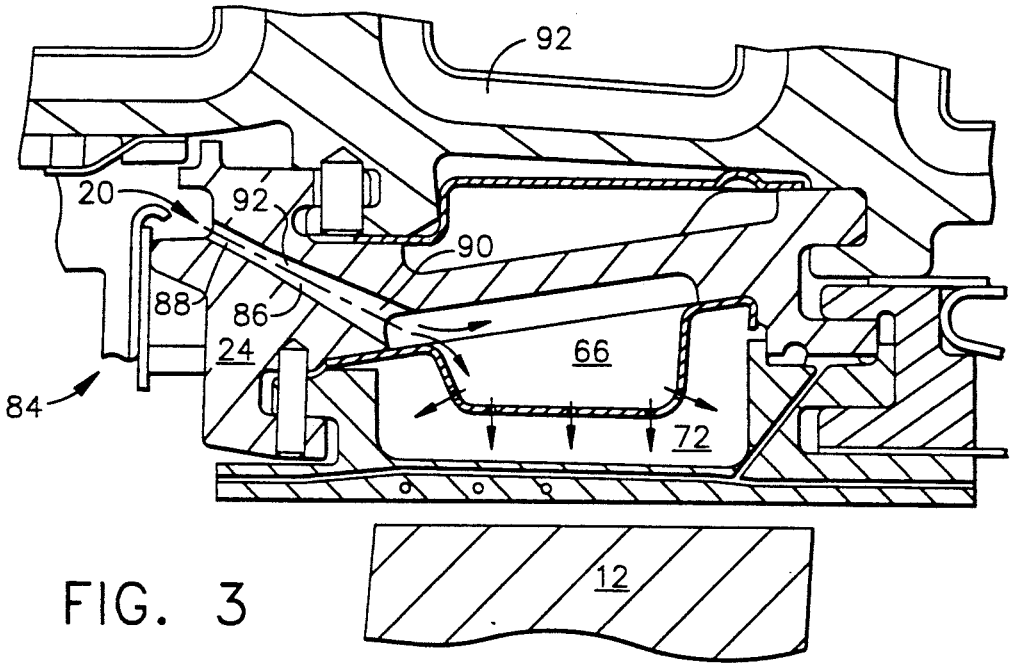
FIG. 3 is an illustration of an axial sectional view of a shroud cooling assembly constructed in accordance with the present invention.

An illustration of an improved shroud cooling assembly 84 is shown in FIG. 3, wherein the plenum inlet metering holes 76 have been replaced by a specially configured metering channels 86 for providing regulated and substantially uniform cooling airflow directly into baffle plenum 66 and a concomitant reduction in flow variation through the shroud cooling ports 80. As shown therein, the metering channel 86 extends angularly inwardly through the hanger 24 to achieve multiple functions as described below and couples the plenum 66 to the compressed supply core cooling flow 20. The metering channel 86 includes a compressor side inlet 88 which is substantially smaller than the plenum side discharge opening 90. In the embodiment illustrated in FIG. 3, the metering channel 86 includes a tapered enlargement frustroconical recuperator 92 wherein the cross-sectional area of the channel gradually expands in the direction of flow . In the illustrated embodiment, the metering channel inlet 88 can comprise a metering section which can be configured as a substantially cylindrical opening. In a typical example, the metering section 88 extends through the hanger over a length which preferably is less than ½ the overall length of the metering channel 86. As will be discussed below in more detail, the metering section 88 as its name implies regulates the mass flow of air to the plenum 66 by establishing an inlet cross-sectional area which provides adequate mass flow at a given pressure ratio. In the illustrated embodiment, a recuperator section 92 directly follows the inlet metering section 88 in the cooling airflow path and comprises a flared opening forming an outlet directly coupled to the baffle plenum 66. The recuperator 92 maintains cooling air mass flow while recovering a percentage of the flow pressure head to ensure the plenum 72 is continually resupplied in substantially a uniform manner. More particularly, by gradually recovering a percentage of the cooling flow pressure head over as long a length as possible, it is possible to minimize the sinusoidal pressure field influence in the baffle plenum 66. It is therefore preferred that the recuperator 92 comprise a substantial portion of metering channel 86, and in a particular embodiment it has been found that recuperators comprising ⅔ or more of the axial length of the metering channel 86 provide substantially uniform cooling air distribution. Further, it has been recognized that airflow turbulence can be minimized by ensuring that the recuperator 92 is flared in a substantially continuous manner wherein the channel cross-sectional area continuously and smoothly increases in the direction of flow. It is therefore preferred that the recuperator outlet comprise as large a diameter as possible consistent with the structural integrity of the hanger 24 and the volume of plenum 66. Therefore, it is preferred that the ratio of the outlet/inlet areas comprise 2 or more and occur over a channel length which is at least 10 d wherein d is the diameter of the channel inlet 88. Such gradual opening allows for a substantially improved pressure distribution within the baffle plenum 66.

Figure 4:
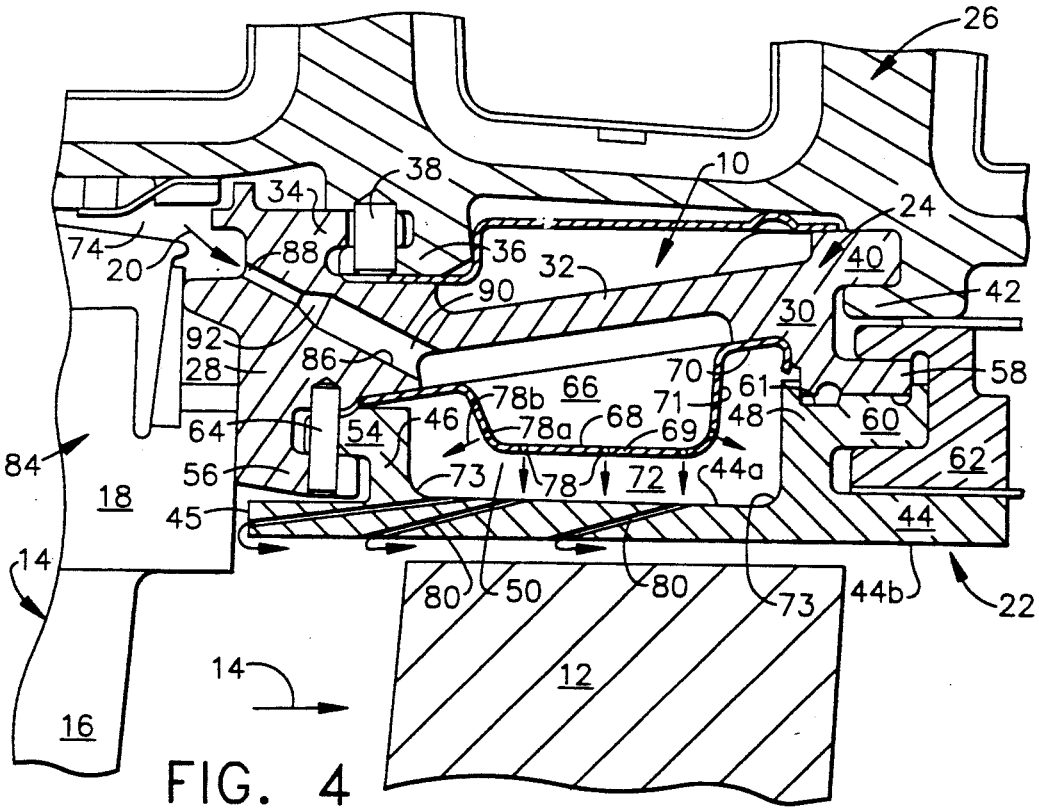
FIG. 4 is an illustration of an axial sectional view of an alternate shroud cooling assembly constructed in accordance with the present invention

An alternate embodiment of the metering channel 86 is illustrated in FIG. 4 wherein cylindrical inlet and outlet sections are coupled by an intermediate frustroconical recuperator 92. In the embodiment, the inlet 88 again serves to meter the cooling airflow 20, the recuperator 92 serves to recover a percentage of pressure head and the cylindrical outlet 90 provides the discharge point into the baffle plenum.

In operation, it will be appreciated that the metering channel 86 thus functions to control the cooling airflow by regulating the mass flow and reducing the sinusoidal pressure influence in the baffle plenum thus resulting in a more uniform distribution of shroud cooling flow. The static pressure within the metering channel is directly proportional to the cross-sectional area of the channel 86 and as the cross-sectional area expands the static flow pressure within the channel 86 is recovered without a reduction in the mass flow which is directly proportional to cross-sectional area. Accordingly, the pressure differential at the interface between the metering channel 86 and plenum 66 is reduced. Therefore, the improved cooling assembly achieves a reduced pressure variation within plenums 66 and 72, and a more uniform flow distribution through the shroud cooling ports 80.

An improved cooling assembly 84 employing both the improved metering holes 80 of co-pending U.S. patent application Ser. No. 07/702,549 and the metering channel 86 has been found to achieve dramatic results. A recent engine test employing the improved cooling assembly demonstrated that a shroud in accordance with the present invention and of a conventional material when receiving a small percentage of core flow, showed a wear visually equivalent to or better than the wear of a conventional shroud which experienced twice the airflow. The improved plenum pressure distribution and in conjunction with the improved interaction of the impingement, convection and film cooling mechanisms has permitted a reduction in the number of shroud cooling ports 80 in a typical shroud from approximately 40 to approximately 30. The improved cooling assembly allows a more precisely regulated amount of air to be discharged from cooling holes 80 in a predetermined manner to permit a reduction in cooling flow and an increase in engine efficiency.

In prior embodiments, no concern was given to the shape of the metering channel, the position of convection cooling passages relative to each other, and their interaction with other cooling mechanisms and, as a result, amounts of air used to cool the shrouds was greatly exceeded. The contribution of this excess air to the impingement cooling of the shroud was therefore lost. More significantly, certain shroud locations were receiving flow to a greater extent than was necessary and thus precious cooling air was wasted. By virtue of the present invention, impingement and convection cooling are not needlessly duplicated to overcool any portions of the shroud, and highly efficient use of cooling air is thus achieved. Less high pressure cooling air is then required to hold the shroud temperature to safe operating limits, thus affording increased engine operating efficiency because with the improved cooling mechanism interaction, the amount of cooling air has been reduced.

As seen in FIG. 4, air flowing through the cooling passages, after having impingement cooled the shroud back surface, not only convection cools the most forward portion of the shroud, but impinges upon and cools other adjacent portions of the engine. Having served these purposes, the cooling air mixes with the main gas stream and flows along the base front surface **44*b* to film cool the shroud. The cooling ports 80 are formed as rows across the shroud which extend through the shroud section base 44 from back surface inlets 44*a* to front surface outlets 44*b*** and convey impingement cooling air which then serves to convection cool the forward portion of the shroud. Upon exiting these ports, the cooling air mixes with the main gas stream and flows along the base front surface to film cool the shroud.

It should also be noted that the majority of cooling ports 80 are skewed away from the direction of the main gas stream, arrow 14. Consequently, the possibility of mainstream hot gas ingestion into the cooling ports is minimized.

From the foregoing Detailed Description, it is seen that the present invention provides a shroud cooling assembly wherein three modes of cooling are utilized to maximum thermal benefit individually an interactively to maintain shroud temperature within safe limits. The interaction between cooling modes is controlled such that at critical locations where one cooling mode is of lessened effectiveness, another cooling mode is operating at near maximum effectiveness. Further, the cooling modes are coordinated such that redundant cooling of any portions of the shroud is avoided. Cooling air is thus utilized with utmost efficiency, enabling satisfactory shroud cooling to be achieved with less cooling air. Moreover, a predetermined degree of shroud cooling is directed to reducing heat conduction out into the shroud support structure to control thermal expansion thereof and, in turn, afford active control of the clearance between the shroud and the high pressure turbine blades.

It is seen from the foregoing, that the objectives of the present invention are effectively attained, and, since certain changes may be made in the construction set forth, it is intended that matters of detail be taken as illustrative and not in a limiting sense.

Having described the invention, what is claimed as new and desired to secure by Letters Patent is:

1. A shroud cooling assembly for a gas turbine engine comprising, in combination:

(a) a plurality of arcuate shroud sections circumferentially arranged to surround the rotor blades of a high pressure section of the gas turbine engine, each said shroud section including:

1) a base having a radially outer back surface, a radially inner front surface forming a portion of a radially outer boundary for the engine main gas stream flowing through the high pressure turbine, an upstream end and a downstream end, 2) a fore rail extending radially outwardly from said base adjacent said upstream end thereof, 3) an aft rail extending radially outwardly from said base adjacent said downstream end thereof, 4) a pair of spaced side rails extending radially outwardly from said base in conjoined relation with said fore and aft rails, and 5) a plurality of convection cooling passages extending through said base with inlets at said base back surface and outlets at said base front surface, (b) a plurality of arcuate hanger sections secured to the outer case of the gas turbine engine for supporting said shroud sections, each said hanger section including at least one metering channel therethrough for providing a controlled flow of substantially uniformly pressurized cooling air from a nozzle plenum, said metering channel including an inlet and an outlet, and said channel receiving flow at a first pressure and discharging flow at a second pressure, each said hanger section defining with said base back surface and said fore, aft and side rails of each said shroud section, a shroud chamber; and (c) a pan-shaped baffle attached to each said hanger section in position within each said shroud chamber to align with said hanger section a baffle plenum in communication with said metering channel to receive substantially uniformly pressurized cooling air directly from said nozzle plenum, said baffle including a plurality of perforations through with streams of cooling air are radially inwardly directed into impingement with one of said shroud sections, whereby to maximize impingement cooling of said shroud sections, the impingement cooling air then flowing through said passages to convection cool said shroud sections and ultimately flowing along said shroud front surface to provide film cooling of said shroud sections; and (d) wherein said metering channel includes a frustroconical recuperator section positioned to provide an increase in the cross-sectional channel area in the direction of flow, wherein said frustroconical recuperator section i) equilibrates the channel flow pressure with the baffle plenum pressure, ii) minimizes turbulence of said channel flow discharging into said baffle plenum, and iii) reduces the possibility of pressure induced fluctuations within said baffle plenum and said shroud chamber.

2. The shroud cooling assembly defined in claim 1, wherein each said metering channel includes a substantially cylindrical metering section having a cross-sectional area for regulating the mass flow through the channel.

3. The shroud cooling assembly defined in claim 1, wherein said metering channel includes a cylindrical metering section proximate said inlet and wherein said frustroconical recuperator section is proximate said outlet.

4. The shroud cooling assembly defined in claim 1, wherein said metering channel includes a substantially cylindrical metering section proximate said inlet and an intermediate second comprising said frustroconical recuperator section and a substantially cylindrical stabilizing section proximate said outlet.

5. The shroud cooling assembly defined in claim 1, wherein the frustroconical recuperator section proximate the inlet has a cross-sectional area and proximate the outlet has a cross-sectional area and wherein the ratio of cross-sectional areas is greater than or equal to 2.

6. The shroud cooling assembly defined in claim 1, the frustroconical recuperator section has a relative axial flow dimension approximately equal to 10*d* wherein d is the diameter of the inlet portion.

7. The shroud cooling assembly defined in claim 1, wherein the inlet comprises an axial length X and the frustroconical recuperator section comprises an axial length y and wherein the ratio of y/x is approximately equal to 1.5.

8. The shroud cooling assembly defined in claim 1, wherein the metering channel extends through the hanger at an angle of approximately 25–45 degrees relative to the engine centerline.

9. The shroud cooling assembly defined in claim 1, wherein the metering channel extends angularly through the hanger in the direction of air flow to said baffle plenum.

* * * * *